US009093796B2

(12) United States Patent
Taylor et al.

(10) Patent No.: US 9,093,796 B2
(45) Date of Patent: Jul. 28, 2015

(54) MANAGED ELECTRICAL CONNECTIVITY SYSTEMS

(71) Applicant: ADC Telecommunications, Inc., Berwyn, PA (US)

(72) Inventors: Chris Taylor, Cheltenham Glos (GB); Loren J. Mattson, Richfield, MN (US)

(73) Assignee: ADC Telecommunications, Inc., Berwyn, PA (US)

( * ) Notice: Subject to any disclaimer, the term of this patent is extended or adjusted under 35 U.S.C. 154(b) by 24 days.

(21) Appl. No.: 13/930,675

(22) Filed: Jun. 28, 2013

(65) Prior Publication Data

US 2014/0011382 A1 Jan. 9, 2014

Related U.S. Application Data

(60) Provisional application No. 61/668,711, filed on Jul. 6, 2012.

(51) Int. Cl.

| | |
|---|---|
| ***H01R 24/00*** | (2011.01) |
| ***H01R 13/703*** | (2006.01) |
| ***H01R 24/64*** | (2011.01) |

(52) U.S. Cl.

CPC ..... *H01R 13/703* (2013.01); *H01R 13/7032* (2013.01); *H01R 13/7033* (2013.01); *H01R 24/64* (2013.01)

(58) Field of Classification Search

CPC ..... H01R 23/025
USPC ..... 439/676, 955
See application file for complete search history.

(56) References Cited

U.S. PATENT DOCUMENTS

| | | | |
|---|---|---|---|
| 3,243,761 | A | 3/1966 | Piorunneck |
| 4,127,317 | A | 11/1978 | Tyree |
| 4,953,194 | A | 8/1990 | Hansen et al. |
| 4,968,929 | A | 11/1990 | Hauck et al. |

(Continued)

FOREIGN PATENT DOCUMENTS

| | | |
|---|---|---|
| CA | 2499803 | 4/2004 |
| DE | 102 44 304 | 3/2004 |

(Continued)

OTHER PUBLICATIONS

*Avaya's Enhanced Systimax® iPatch System Enables IT Managers to Optimise Network Efficiency and Cut Downtime*, Press Release, May 20, 2003, obtained from http://www.avaya.com/usa/about-avaya/newsroom/news-releases/2003/pr-030520 on Jan. 7, 2009.

(Continued)

*Primary Examiner* — Phuong Dinh
(74) *Attorney, Agent, or Firm* — Merchant & Gould P.C.

(57) ABSTRACT

A receptacle block defines at least one socket at which a plug connector may be received. First contact members extend into each socket to receive a primary signal from a plug connector. Second contact members extend into one or more of the sockets to read physical layer information from any plug connector inserted into the socket. A sensing contact is positioned to electrically connect to one of the second contact members when a plug connector is inserted into the respective socket. At least a portion of the sensing contact is flexible to follow the movement of the one second contact member. In certain implementations, the second contact members have resilient sections that are identical to each other.

21 Claims, 11 Drawing Sheets

(56) References Cited

U.S. PATENT DOCUMENTS 5,030,123 A 7/1991 Silver
5,052,940 A 10/1991 Bengal
5,107,532 A 4/1992 Hansen et al.
5,161,988 A 11/1992 Krupka
5,166,970 A 11/1992 Ward
5,197,895 A 3/1993 Stupecky
5,222,164 A 6/1993 Bass, Sr. et al.
5,265,187 A 11/1993 Morin et al.
5,305,405 A 4/1994 Emmons et al.
5,353,367 A 10/1994 Czosnowski et al.
5,382,182 A 1/1995 Shen et al.
5,393,249 A 2/1995 Morgenstern et al.
5,394,503 A 2/1995 Dietz, Jr. et al.
5,413,494 A 5/1995 Dewey et al.
5,415,570 A 5/1995 Sarkissian
5,418,334 A 5/1995 Williams
5,419,717 A 5/1995 Abendschein et al.
5,448,675 A 9/1995 Leone et al.
5,467,062 A 11/1995 Burroughs et al.
5,470,251 A 11/1995 Sano
5,473,715 A 12/1995 Schofield et al.
5,483,467 A 1/1996 Krupka et al.
5,660,567 A 8/1997 Nierlich et al.
5,674,085 A 10/1997 Davis
5,685,741 A 11/1997 Dewey et al.
5,704,797 A 1/1998 Meyerhoefer et al.
5,712,942 A 1/1998 Jennings et al.
5,800,192 A 9/1998 David
5,821,510 A 10/1998 Cahen et al.
5,854,824 A 12/1998 Bengal et al.
5,871,368 A 2/1999 Erdner
5,910,776 A 6/1999 Black
6,002,331 A 12/1999 Laor
6,095,837 A 8/2000 David et al.
6,095,851 A 8/2000 Laity et al.
6,116,961 A 9/2000 Henneberger et al.
6,222,908 B1 4/2001 Bartolutti et al.
6,222,975 B1 4/2001 Gilbert et al.
6,227,911 B1 5/2001 Boutros et al.
6,234,830 B1 5/2001 Ensz et al.
6,238,235 B1 5/2001 Shavit et al.
6,244,908 B1 6/2001 Hammond et al.
6,280,231 B1 8/2001 Nicholls
6,285,293 B1 9/2001 German et al.
6,300,877 B1 10/2001 Schannach et al.
6,330,148 B1 12/2001 Won et al.
6,330,307 B1 12/2001 Bloch et al.
6,350,148 B1 2/2002 Bartolutti et al.
6,364,694 B1 4/2002 Lien
6,371,780 B1 4/2002 Aponte et al.
6,421,322 B1 7/2002 Koziy et al.
6,422,895 B1 7/2002 Lien
6,424,710 B1 7/2002 Bartolutti et al.
6,431,892 B1 8/2002 Shupe et al.
6,456,768 B1 9/2002 Boncek et al.
D466,479 S 12/2002 Pein et al.
6,499,861 B1 12/2002 German et al.
6,511,231 B2 1/2003 Lampert et al.
6,522,737 B1 2/2003 Bartolutti et al.
6,554,484 B2 4/2003 Lampert
6,574,586 B1 6/2003 David et al.
6,612,856 B1 9/2003 McCormack
6,626,697 B1 9/2003 Martin et al.
6,636,152 B2 10/2003 Schannach et al.
6,641,443 B1 11/2003 Itano et al.
6,663,436 B1 12/2003 Arnett et al.
6,684,179 B1 1/2004 David
6,725,177 B2 4/2004 David et al.
6,743,044 B2 6/2004 Musolf et al.
6,780,035 B2 8/2004 Bohbot
6,786,776 B2 9/2004 Itano et al.
6,793,408 B2 9/2004 Levy et al.
6,802,735 B2 10/2004 Pepe et al.
6,808,116 B1 10/2004 Eslambolchi et al.
6,811,446 B1 11/2004 Chang
6,814,624 B2 11/2004 Clark et al.
6,835,091 B2 12/2004 Oleynick et al.
6,850,685 B2 2/2005 Tinucci et al.
6,898,368 B2 5/2005 Colombo et al.
6,905,363 B2 6/2005 Musolf et al.
6,932,517 B2 8/2005 Swayze et al.
D510,068 S 9/2005 Haggay et al.
6,939,168 B2 9/2005 Oleynick et al.
6,961,675 B2 11/2005 David
6,971,895 B2 12/2005 Sago et al.
6,976,867 B2 12/2005 Navarro et al.
7,077,710 B2 7/2006 Haggay et al.
7,081,808 B2 7/2006 Colombo et al.
7,112,090 B2 9/2006 Caveney et al.
7,123,810 B2 10/2006 Parrish
7,153,142 B2 12/2006 Shifris et al.
7,165,728 B2 1/2007 Durrant et al.
7,193,422 B2 3/2007 Velleca et al.
7,207,819 B2 4/2007 Chen
7,210,858 B2 5/2007 Sago et al
7,226,217 B1 6/2007 Benton et al.
7,234,944 B2 6/2007 Nordin et al.
7,241,157 B2 7/2007 Zhuang et al.
7,297,018 B2 11/2007 Caveney et al.
7,312,715 B2 12/2007 Shalts et al.
D559,186 S 1/2008 Kelmer
7,314,392 B2 1/2008 Pharn et al.
7,314,393 B2 1/2008 Hashim
7,315,224 B2 1/2008 Gurovich et al.
7,352,289 B1 4/2008 Harris
7,356,208 B2 4/2008 Becker
7,370,106 B2 5/2008 Caveney
7,384,300 B1 6/2008 Salgado et al.
7,396,245 B2 7/2008 Huang et al.
7,479,032 B2 1/2009 Hoath et al.
7,497,709 B1 3/2009 Zhang
7,519,000 B2 4/2009 Caveney et al.
7,534,137 B2 5/2009 Caveney et al.
7,552,872 B2 6/2009 Tokita et al.
7,563,116 B2 7/2009 Wang
7,570,861 B2 8/2009 Smrha et al.
7,575,454 B1 8/2009 Aoki et al.
7,588,470 B2 9/2009 Li et al.
7,591,667 B2 9/2009 Gatnau Navarro et al.
7,607,926 B2 10/2009 Wang
7,635,280 B1 12/2009 Crumlin et al.
7,648,377 B2 1/2010 Naito et al.
7,682,174 B2 3/2010 Chen
7,722,370 B2 5/2010 Chin
7,727,026 B2 6/2010 Qin et al.
7,785,154 B2 8/2010 Peng
7,798,832 B2 9/2010 Qin et al.
7,811,119 B2 10/2010 Caveney et al.
7,814,240 B2 10/2010 Salgado et al.
7,867,017 B1 1/2011 Chen
7,869,426 B2 1/2011 Hough et al.
7,872,738 B2 1/2011 Abbott
7,880,475 B2 2/2011 Crumlin et al.
7,914,310 B2 3/2011 Johansson et al.
8,157,582 B2 4/2012 Frey et al.
8,282,425 B2 10/2012 Bopp et al.
8,287,316 B2 10/2012 Pepe et al.
8,303,348 B2 11/2012 Straka et al.
8,388,386 B2 3/2013 Peterson
8,408,926 B1 4/2013 Chang
8,425,255 B2 4/2013 Erickson et al.
8,480,438 B2 * 7/2013 Mattson ..... 439/676
8,715,012 B2 * 5/2014 Taylor ..... 439/676
8,795,003 B2 * 8/2014 Mattson ..... 439/676
2002/0008613 A1 1/2002 Nathan et al.
2004/0052498 A1 3/2004 Colombo et al.
2004/0240807 A1 12/2004 Frohlich et al.
2005/0186819 A1 8/2005 Velleca et al.
2005/0227524 A1 10/2005 Zhuang et al.
2006/0160395 A1 7/2006 Macauley et al.
2006/0234564 A1 10/2006 Pharn et al.
2007/0237470 A1 10/2007 Aronson et al.
2007/0254529 A1 11/2007 Pepe et al.
2008/0090454 A1 4/2008 Hoath et al.

(56) References Cited

U.S. PATENT DOCUMENTS

| | | | | |
|---|---|---|---|---|
| 2008/0100467 | A1 | 5/2008 | Downie et al. | |
| 2008/0153343 | A1 | 6/2008 | Kobayashi et al. | |
| 2008/0196519 | A1 | 8/2008 | Salgado et al. | |
| 2009/0097846 | A1 | 4/2009 | Kozischek et al. | |
| 2009/0166404 | A1 | 7/2009 | German et al. | |
| 2009/0170359 | A1 | 7/2009 | Chin | |
| 2009/0215310 | A1 | 8/2009 | Hoath et al. | |
| 2009/0232455 | A1 | 9/2009 | Nhep | |
| 2010/0046064 | A1 | 2/2010 | Hasegawa et al. | |
| 2010/0048064 | A1 | 2/2010 | Peng | |
| 2010/0211664 | A1 | 8/2010 | Raza et al. | |
| 2010/0211665 | A1 | 8/2010 | Raza et al. | |
| 2010/0211697 | A1 | 8/2010 | Raza et al. | |
| 2010/0215049 | A1 | 8/2010 | Raza et al. | |
| 2011/0115494 | A1 | 5/2011 | Taylor et al. | |
| 2011/0228473 | A1 | 9/2011 | Anderson et al. | |
| 2012/0003877 | A1 | 1/2012 | Bareel et al. | |
| 2012/0021636 | A1 | 1/2012 | Debenedictis et al. | |
| 2012/0184141 | A1* | 7/2012 | Mattson | 439/620.21 |
| 2012/0322310 | A1 | 12/2012 | Taylor | |

FOREIGN PATENT DOCUMENTS

| | | | |
|---|---|---|---|
| DE | 10 2004 033 940 | A1 | 2/2006 |
| DE | 10 2008 034 261 | A1 | 1/2010 |
| DE | 10 2008 052 857 | A1 | 4/2010 |
| WO | WO 00/65696 | | 11/2000 |
| WO | WO 02/47215 | A1 | 6/2002 |
| WO | WO 2010/001400 | A1 | 1/2010 |
| WO | WO 2010/081186 | A1 | 7/2010 |
| WO | WO 2010/121639 | A1 | 10/2010 |

OTHER PUBLICATIONS

*Avaya's Enhanced Systimax® iPatch System Enables IT Managers to Optimise Network Efficiency and Cut Downtime*, Press Release, May 9, 2003, obtained from http://www.avaya.com/usa/about-avaya/newsroom/news-releases/2003/pr-030509 on Jan. 7, 2009.

*Intelligent patching systems carving out a 'large' niche*, Cabling Installation & Maintenance, vol. 12, Issue 7, Jul. 2004 (5 pages).

*intelliMAC: The intelligent way to make Moves, Adds or Changes!* NORDX/CDT ©2003 (6 pages).

iTRACS Physical Layer Manager FAQ, obtained on Jun. 11, 2008 from http://www.itracs.com/products/physical-layer-manager-faqs.html (6 pages).

Meredith, L., "Managers missing point of intelligent patching," *Daa Center News*, Jun. 21, 2005, obtained Dec. 2, 2008 from http://searchdatacenter.techtarget.com/news/article/0,289142,sid80_gcil099991,00.html.

*Systimax® iPatch System Wins Platinum Network of the Year Award*, Press Release, Jan. 30, 2003, obtained from http://www.avaya.com/usa/about-avaya/newsroom/news-releases/2003/pr-030130a on Jan. 7, 2009.

Ohtsuki, F. et al., "Design of Optical Connectors with ID Modules," Electronics ad Communications in Japan, Part 1, vol. 77, No. 2, pp. 94-105 (Feb. 1994).

TrueNet; TFP Series Rack Mount Fiber Panels, Spec Sheet; May 2008; 8 pages.

International Search Report and Written Opinion for PCT/US2013/048643 mailed Sep. 27, 2013.

* cited by examiner

MANAGED ELECTRICAL CONNECTIVITY SYSTEMS

CROSS-REFERENCE TO RELATED APPLICATION

The present patent application claims the benefit of U.S. Provisional Patent Application Ser. No. 61/668,711, filed Jul. 6, 2012, which application is hereby incorporated by reference in its entirety.

BACKGROUND

In communications infrastructure installations, a variety of communications devices can be used for switching, cross-connecting, and interconnecting communications signal transmission paths in a communications network. Some such communications devices are installed in one or more equipment racks to permit organized, high-density installations to be achieved in limited space available for equipment.

Communications devices can be organized into communications networks, which typically include numerous logical communication links between various items of equipment. Often a single logical communication link is implemented using several pieces of physical communication media. For example, a logical communication link between a computer and an inter-networking device such as a hub or router can be implemented as follows. A first cable connects the computer to a jack mounted in a wall. A second cable connects the wall-mounted jack to a port of a patch panel, and a third cable connects the inter-networking device to another port of a patch panel. A "patch cord" cross connects the two together. In other words, a single logical communication link is often implemented using several segments of physical communication media.

Network management systems (NMS) are typically aware of logical communication links that exist in a communications network, but typically do not have information about the specific physical layer media (e.g., the communications devices, cables, couplers, etc.) that are used to implement the logical communication links. Indeed, NMS systems typically do not have the ability to display or otherwise provide information about how logical communication links are implemented at the physical layer level.

SUMMARY

In accordance with some aspects of the disclosure, a receptacle block includes a block housing defining at least one socket configured to receive a plug from a front of the block housing. The block housing defines at least one opening aligned with the at least one socket. The at least one opening extends between the at least one socket to an exterior of the block housing. First contact members extend into each socket from the first end of the block housing. Each of the first contact members is electrically conductive. At least a first media reading interface is positioned within the at least one opening of the block housing. The first media reading interface includes electrically conductive second contact members and an electrically conductive sensing contact. The second contact members extend into the socket from the second end of the block housing. Each of the second contact members is electrically isolated from the first contact members. Each of the second contact members has a resilient section that is configured to move between a raised position and a depressed position. The sensing contact is physically separate and electrically isolated from the second contact members when the resilient sections of the second contact members are in the raised positions. The sensing contact has a deflecting section that extends between a mounting section and a swiping section. The sensing contact extends laterally across the second contact members so that the swiping section is aligned with a first of the second contact members and the deflecting section extends across a remainder of the second contact members so that movement of the resilient sections of the second contact members to the depressed positions causes the first of the second contact members to engage the swiping section of the sensing contact and the remainder of the second contact members to maintain physical separation and electrical isolation from the sensing contact.

In accordance with other aspects of the disclosure, a media reading interface includes a support body defining contact slots and a deflection cavity. The deflection cavity extends laterally relative to the contact slots. An electrically conductive sensing contact is disposed in the deflection cavity. The sensing contact has a deflecting section that extends between a mounting section and a swiping section. The sensing contact extends generally orthogonal to the contact elements. Electrically conductive contact elements are disposed in the contact slots and attached to the support body. Each of the contact elements includes a resilient section that laterally aligns with the resilient section of the other contact elements. The resilient section of each contact element is configured to move between a raised position and a depressed position. Each of the contact elements is physically separated and electrically isolated from the sensing contact when in the raised position. A first of the contact elements is aligned with the swiping section of the sensing contact so that movement of the first contact element towards the depressed position brings the first contact element into engagement with the swiping section of the sensing contact. A remainder of the contact elements being aligned with the deflecting section of the sensing contact so that movement of the remainder of the contact elements towards the depressed positions does not bring the remainder of the contact elements into physical or electrical contact with the sensing contact.

In accordance with other aspects of the disclosure, a method of assembling a connector assembly includes mounting a first media reading interface, which includes contact elements having identical resilient sections, to a printed circuit board; positioning a receptacle block over the printed circuit board so that an opening defined in the receptacle block is aligned with the first media reading interface; and mounting the receptacle block directly to the printed circuit board so that the contact elements of the first media reading interface extend into a socket of the receptacle block through the opening. The receptacle block is not directly coupled to the first media reading interface.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Figure 1:
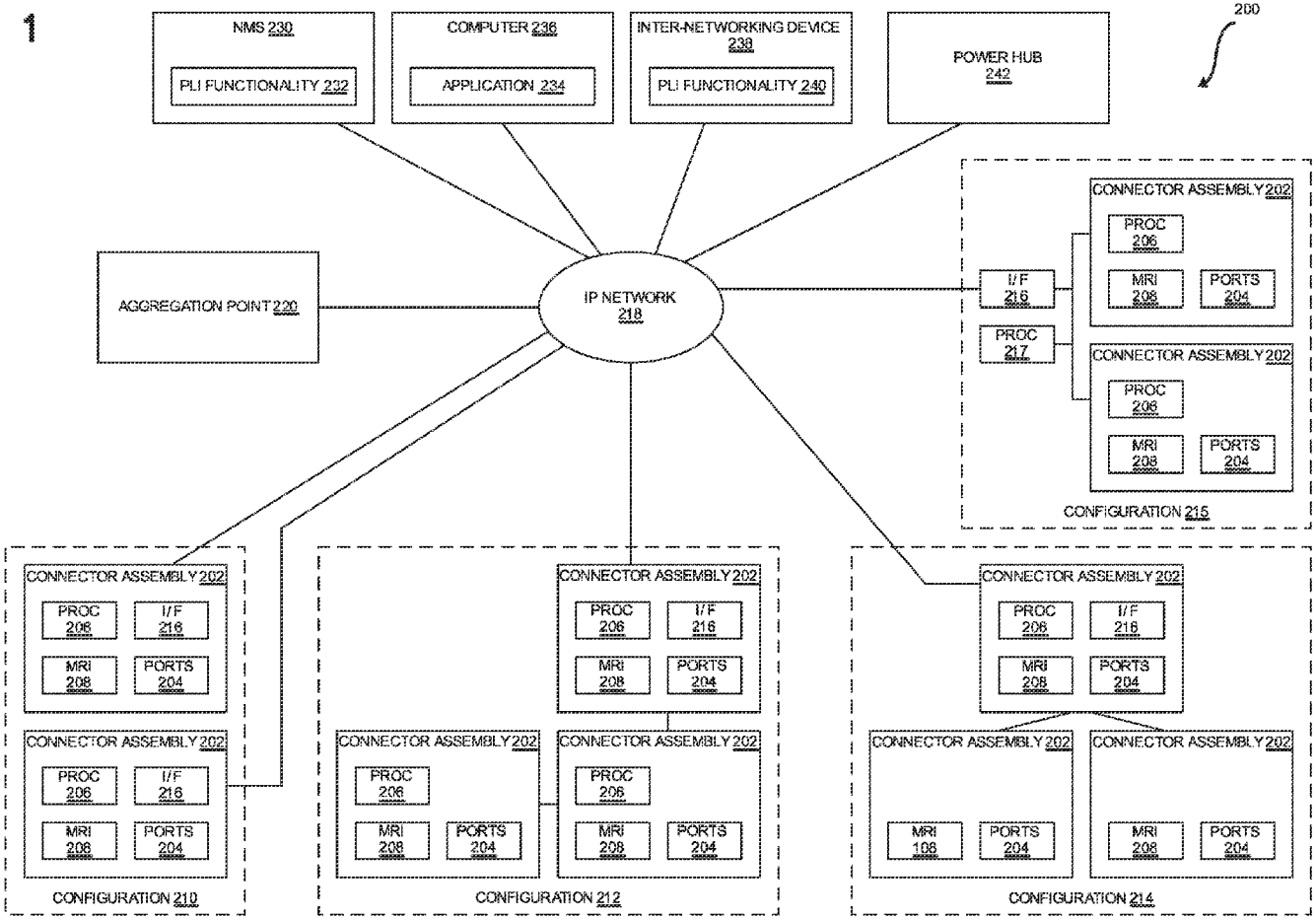
FIG. 1 is a block diagram of one embodiment of a communications management system that includes PLI functionality as well as PLM functionality in accordance with aspects of the present disclosure.

Reference will now be made in detail to exemplary aspects of the present disclosure that are illustrated in the accompanying drawings. Wherever possible, the same reference numbers will be used throughout the drawings to refer to the same or like parts.

In accordance with some aspects of the disclosure, an example communications and data management system includes at least part of a communications network along which communications signals pass. Media segments connect equipment of the communications network. Non-limiting examples of media segments include optical cables, electrical cables, and hybrid cables. This disclosure will focus on electrical media segments. The media segments may be terminated with electrical plugs, electrical jacks, media converters, or other termination components.

In accordance with aspects of the disclosure, the communications and data management system provides physical layer information (PLI) functionality as well as physical layer management (PLM) functionality. As the term is used herein, "PLI functionality" refers to the ability of a physical component or system to identify or otherwise associate physical layer information with some or all of the physical components used to implement the physical layer of the system. As the term is used herein, "PLM functionality" refers to the ability of a component or system to manipulate or to enable others to manipulate the physical components used to implement the physical layer of the system (e.g., to track what is connected to each component, to trace connections that are made using the components, or to provide visual indications to a user at a selected component).

As the term is used herein, "physical layer information" refers to information about the identity, attributes, and/or status of the physical components used to implement the physical layer of the communications system. Physical layer information of the communications system can include media information, device information, and location information. Media information refers to physical layer information pertaining to cables, plugs, connectors, and other such physical media. Non-limiting examples of media information include a part number, a serial number, a plug type, a conductor type, a cable length, cable polarity, a cable pass-through capacity, a date of manufacture, a manufacturing lot number, the color or shape of the plug connector, an insertion count, and testing or performance information. Device information refers to physical layer information pertaining to the communications panels, inter-networking devices, media converters, computers, servers, wall outlets, and other physical communications devices to which the media segments attach. Location information refers to physical layer information pertaining to a physical layout of a building or buildings in which the network is deployed.

In accordance with some aspects, one or more of the components (e.g., media segments, equipment, etc.) of the communications network are configured to store physical layer information pertaining to the component as will be disclosed in more detail herein. Some components include media reading interfaces that are configured to read stored physical layer information from the components. The physical layer information obtained by the media reading interface may be communicated over the network for processing and/or storage.

FIG. 1 is a block diagram of one example implementation of a communications management system 200 that includes PLI functionality as well as PLM functionality. The management system 200 comprises a plurality of connector assemblies 202 (e.g., patch panels, blades, optical adapters, electrical jacks, media converters, transceivers, etc.), connected to an IP network 218. Each connector assembly 202 includes one or more ports 204, each of which is configured to receive a media segment for connection to other media segments or equipment of the management system 200. For the purposes of this disclosure, electrical connector assemblies 202 and electrical media segments will be described. In other implementations, however, optical connector assemblies and media segments may be used.

At least some of the connector assemblies 202 are designed for use with electrical cables that have physical layer information stored in or on them. The physical layer information is configured to be read by a programmable processor 206 associated with one or more connector assemblies 202. In general, the programmable processor 206 communicates with memory of an electrical cable using a media reading interface 208. In some implementations, each of the ports 204 of the connector assemblies 202 includes a respective media reading interface 208. In other implementations, a single media reading interface 208 may correspond to two or more ports 204.

In FIG. 1, four example types of connector assembly configurations 210, 212, 214, and 215 are shown. In the first connector assembly configuration 210, each connector assembly 202 includes its own respective programmable processor 206 and its own respective network interface 216 that is used to communicatively couple that connector assembly 202 to an Internet Protocol (IP) network 218. In the second type of connector assembly configuration 212, connector assemblies 202 are grouped together in proximity to each other (e.g., in a rack, rack system, patch panel, chassis, or equipment closet). Each connector assembly 202 of the group includes its own respective programmable processor 206. However, not all of the connector assemblies 202 include their own respective network interfaces 216.

In the third type of connector assembly configuration 214, some of the connector assemblies 202 (e.g., "masters") in the group include their own programmable processors 206 and network interfaces 216, while others of the connector assemblies 202 (e.g., slaves") do not include their own programmable processors 206 or network interfaces 216. Each programmable processor 206 is able to carry out the PLM functions for both the connector assembly 202 of which it is a part and any of the slave connector assemblies 202 to which the master connector assembly 202 is connected via the local connections.

In the fourth type of connector assembly configuration 215, each of the connector assemblies 202 in a group includes its own "slave" programmable processors 206. Each slave programmable processor 206 is configured to manage the media reading interfaces 208 to determine if physical communication media segments are attached to the port 204 and to read the physical layer information stored in or on the attached physical communication media segments (if the attached segments have such information stored therein or thereon). Each of the slave programmable processors 206 in the group also is communicatively coupled to a common "master" programmable processor 217. The master processor 217 communicates the physical layer information read from by the slave processors 206 to devices that are coupled to the IP network 218. For example, the master programmable processor 217 may be coupled to a network interface 216 that couples the master processor 217 to the IP network 218.

In accordance with some aspects, the communications management system 200 includes functionality that enables the physical layer information captured by the connector assemblies 202 to be used by application-layer functionality outside of the traditional physical-layer management application domain. For example, the management system 200 may include an aggregation point 220 that is communicatively coupled to the connector assemblies 202 via the IP network 218. The aggregation point 220 can be implemented on a standalone network node or can be integrated along with other network functionality.

The aggregation point 220 includes functionality that obtains physical layer information from the connector assemblies 202 (and other devices) and stores the physical layer information in a data store. The aggregation point 220 also can be used to obtain other types of physical layer information. For example, this information can be provided to the aggregation point 220, for example, by manually entering such information into a file (e.g., a spreadsheet) and then uploading the file to the aggregation point 220 (e.g., using a web browser) in connection with the initial installation of each of the various items. Such information can also, for example, be directly entered using a user interface provided by the aggregation point 220 (e.g., using a web browser).

The management system 200 also may include a network management system (NMS) 230 includes PLI functionality 232 that is configured to retrieve physical layer information from the aggregation point 220 and provide it to the other parts of the NMS 230 for use thereby. The NMS 230 uses the retrieved physical layer information to perform one or more network management functions. In certain implementations, the NMS 230 communicates with the aggregation point 220 over the IP network 218. In other implementations, the NMS 230 may be directly connected to the aggregation point 220.

An application 234 executing on a computer 236 also can use the API implemented by the aggregation point 220 to access the PLI information maintained by the aggregation point 220 (e.g., to retrieve such information from the aggregation point 220 and/or to supply such information to the aggregation point 220). The computer 236 is coupled to the IP network 218 and accesses the aggregation point 220 over the IP network 218.

One or more inter-networking devices 238 used to implement the IP network 218 include physical layer information (PLI) functionality 240. The PLI functionality 240 of the inter-networking device 238 is configured to retrieve physical layer information from the aggregation point 220 and use the retrieved physical layer information to perform one or more inter-networking functions. Examples of inter-networking functions include Layer 1, Layer 2, and Layer 3 (of the OSI model) inter-networking functions such as the routing, switching, repeating, bridging, and grooming of communication traffic that is received at the inter-networking device.

Additional details pertaining to example communications management system 200 can be found in U.S. application Ser. No. 12/907,724, filed Oct. 19, 2010, and titled "Managed Electrical Connectivity Systems," the disclosure of which is hereby incorporated herein by reference.

Figure 2:
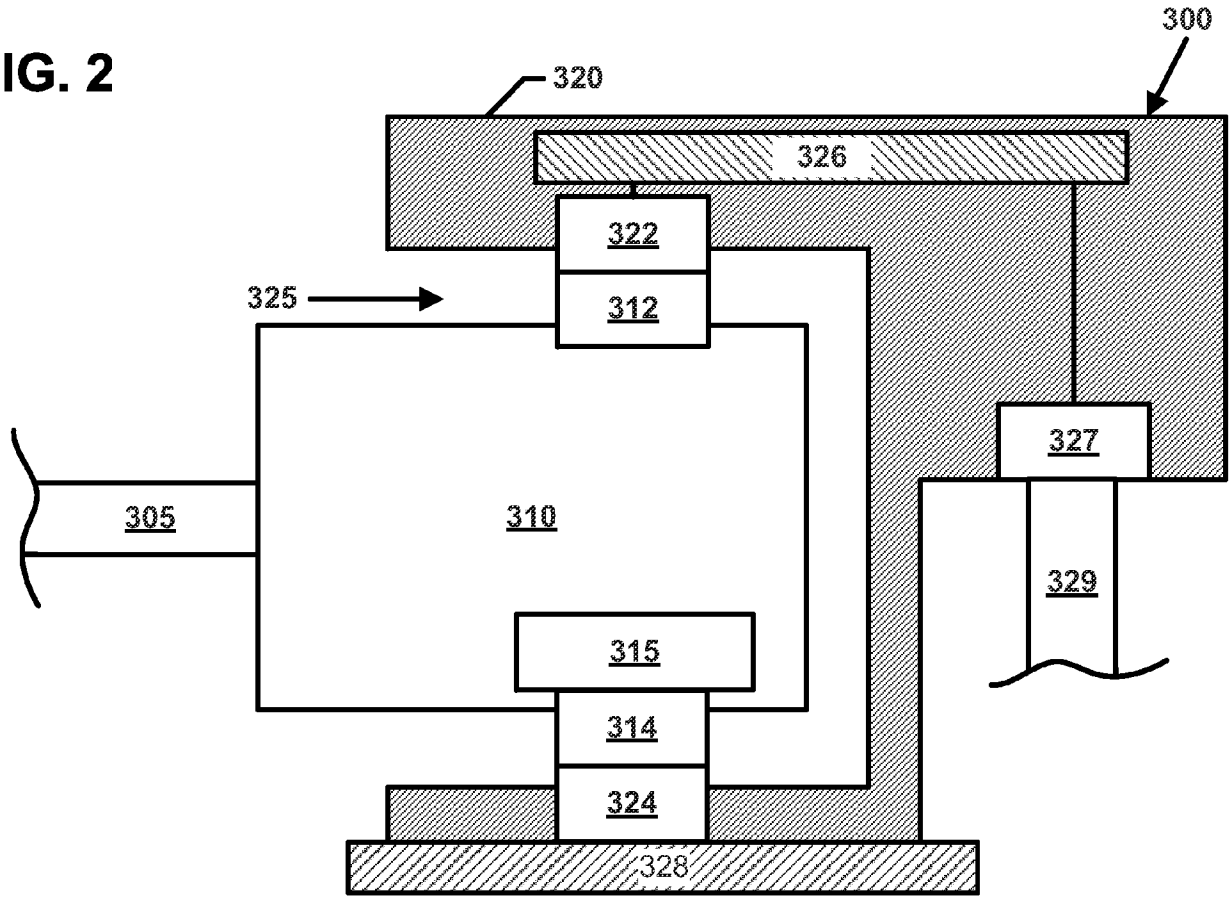
FIG. 2 is a block diagram of one high-level example of a port and media reading interface that are suitable for use in the management system of FIG. 1 in accordance with aspects of the present disclosure.

FIG. 2 is a schematic diagram of one example connector assembly configured to collect physical layer information from a connector arrangement terminating a media segment. The connector assembly is implemented as a jack module 320 and the connector arrangement is implemented as an electrical plug connector 310. The plug connector 310 terminates at least a first electrical media segment (e.g., a conductor cable) 305 and the jack module 320 terminates at least second electrical media segments (e.g., twisted pairs of copper wires) 329. The jack module 320 defines at least one socket port 325 in which the plug connector 310 can be accommodated.

Each electrical segment 305 of the plug connector 310 carries communication signals to primary contact members 312 on the plug connector 310. The jack module 320 includes a primary contact arrangement 322 that is accessible from the socket port 325. The primary contact arrangement 322 is aligned with and configured to interface with the primary contact members 312 to receive the communications signals from the primary contact members 312 when the plug connector 310 is inserted into the socket 325 of the jack module 320.

The jack module 320 is electrically coupled to one or more printed circuit boards. For example, the jack module 320 can support or enclose a first printed circuit board 326, which connects to insulation displacement contacts (IDCs) 327 or to another type of electrical contacts. The IDCs 327 terminate the electrical segments 329 of physical communications media (e.g., conductive wires). The first printed circuit board 326 manages the primary communication signals carried from the conductors terminating the cable 305 to the electrical segments 329 that couple to the IDCs 327.

In accordance with some aspects, the plug connector 310 can include a storage device 315 configured to store physical layer information. The connector arrangement 310 also includes second contact members 314 that are electrically coupled (i.e., or otherwise communicatively coupled) to the storage device 315. In one implementation, the storage device 315 is implemented using an EEPROM (e.g., a PCB surface-mount EEPROM). In other implementations, the storage device 315 is implemented using other non-volatile memory device. Each storage device 315 is arranged and configured so that it does not interfere or interact with the communications signals communicated over the media segment 305.

The jack module 320 also includes a second contact arrangement (e.g., a media reading interface) 324. In certain implementations, the media reading interface 324 is accessible through the socket port 325. The second contact arrangement 324 is aligned with and configured to interface with the second contact members 314 of the plug connector 310 to receive the physical layer information from the storage device 315 when the plug connector 310 is inserted into the socket 325 of the jack module 320.

In some such implementations, the storage device interfaces 314 and the media reading interfaces 324 each include three (3) leads—a power lead, a ground lead, and a data lead. The three leads of the storage device interface 314 come into electrical contact with three (3) corresponding leads of the media reading interface 124 when the corresponding media segment is inserted in the corresponding port 325. In other example implementations, a two-line interface is used with a simple charge pump. In still other implementations, additional leads can be provided (e.g., for potential future applications).

The jack module 320 also can support, enclose, or otherwise be coupled to a second printed circuit board 328, which connects to the second contact arrangement 324. The second printed circuit board 328 manages the physical layer information communicated from the storage device 315 through second contacts 314, 324. In the example shown, the second printed circuit board 328 is positioned on an opposite side of the jack module 320 from the first printed circuit board 326. In other implementations, the printed circuit boards 326, 328 can be positioned on the same side or on different sides. In one implementation, the second printed circuit board 328 is positioned horizontally relative to the jack module 320. In another implementation, the second printed circuit board 328 is positioned vertically relative to the jack module 320.

The second printed circuit board 328 can be communicatively connected to one or more programmable electronic processors (e.g., processor 206 of FIG. 1) and/or one or more network interfaces (e.g., interface 216 of FIG. 1). In one implementation, one or more such processors and interfaces can be arranged as components on the printed circuit board 328. In another implementation, one of more such processor and interfaces can be arranged on a separate circuit board that is coupled to the second printed circuit board 328. For example, the second printed circuit board 328 can couple to other circuit boards via a card edge type connection, a connector-to-connector type connection, a cable connection, etc. The network interface is configured to send the physical layer information to the data network.

Figure 3:
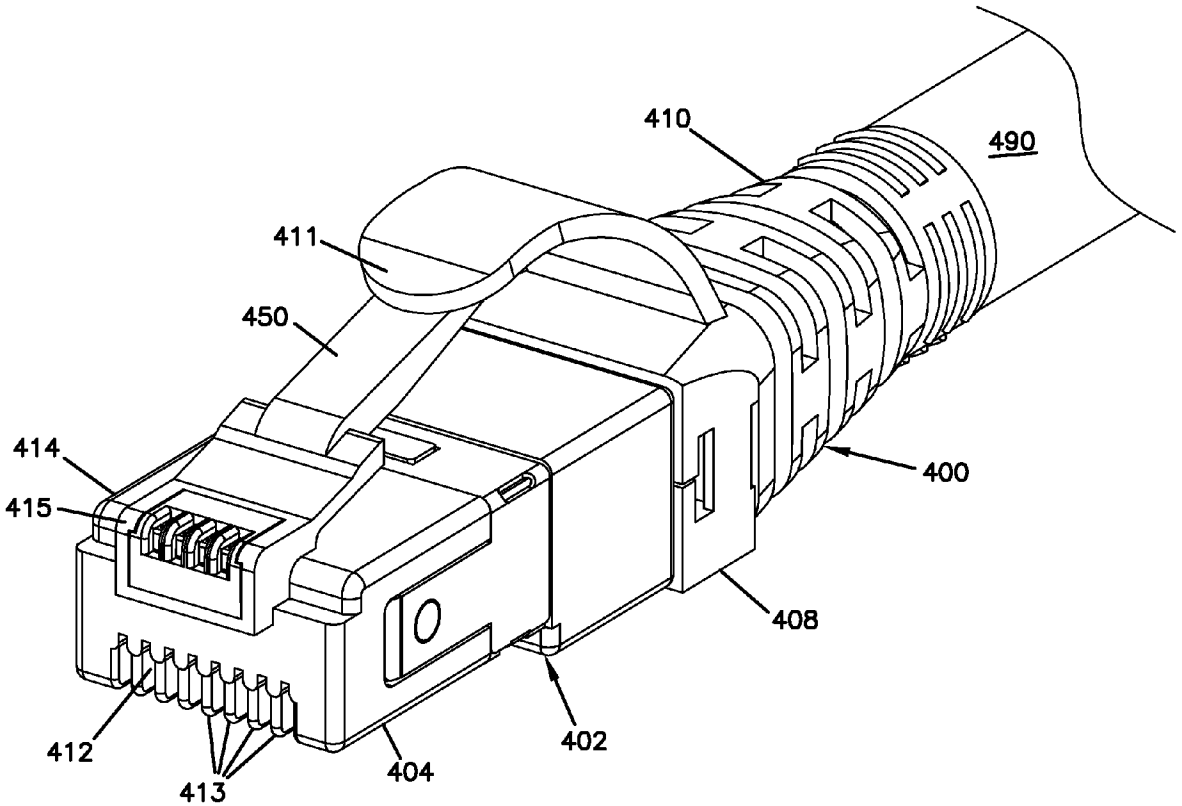
FIGS. 3 and 4 illustrate an example implementation of a connector system including a first example coupler assembly and fiber optic connectors having PLI functionality as well as PLM functionality.
Figure 4:
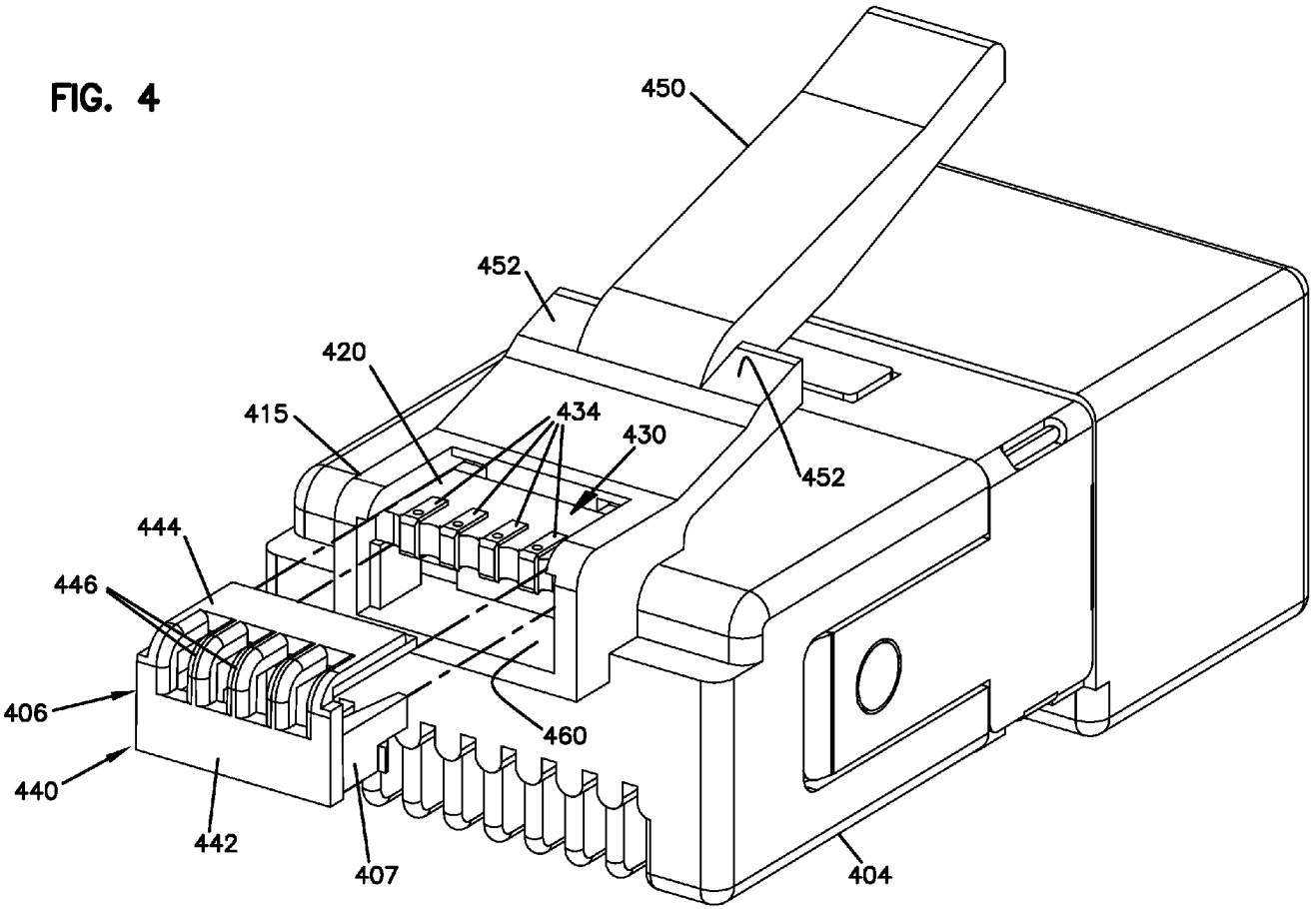

FIGS. 3 and 4 show one example implementation of connector arrangement 400 in the form of an electrical plug connector 402 for terminating an electrical communications cable 490. The plug connector 402 is configured to be received within a port of a jack module (e.g., jack module 320 of FIG. 2). In the example shown, the plug connector 402 is an RJ plug that is configured to connect to the end of a twisted pair copper cable 490 through an RJ jack (e.g., see jack block 510 of FIG. 5).

The plug connector 402 includes a plug nose body 404 that can be attached to a wire manager 408 and/or a boot 410. The plug nose body 404 includes a finger tab 450 and a key member 415 at a first side 414 of the plug 402. The plug nose body 404 holds main signal contacts 412 at a second side 416 of the plug 402. The main signal contacts 412 are electrically connected to conductors (e.g., twisted pair conductors) of the communications cable 490. Ribs 413 protect the main signal contacts 412.

The plug connector 402 is configured to store physical layer information (e.g., an identifier and/or attribute information) pertaining to the electrical cable 490 terminated thereat. In certain implementations, a storage device 430 may be installed on or in the plug body 404 (see FIG. 4). For example, in some implementations, the key member 415 of the plug nose body 404 defines a cavity 460 (FIG. 4) in which the storage device 430 can be stored. In some implementations, the plug 402 includes a plug cover 406 that mounts on the plug nose body 404 to close the cavity 460. Contact members 434 of the storage device 430 are accessible through slots 446 in the key member 415 or plug cover 406.

In some embodiments, the storage device 430 includes a printed circuit board 420. In the example shown, the circuit board 420 can be slid or otherwise positioned along guides defined in the cavity 460. The circuit board 420 includes a substrate with conductive traces electrically connecting contacts and lands. The circuit board 420 also includes circuit components, such as an EEPROM, at the lands. In other embodiments, however, the storage device 430 can include any suitable type of memory. The contact members 434 permit connection of the EEPROM or other memory circuitry to a media reading interface of a coupler assembly as will be described herein. Additional details pertaining to the plug 402 can be found in U.S. application Ser. No. 12/907,724 (incorporated by reference above).

Figure 5:
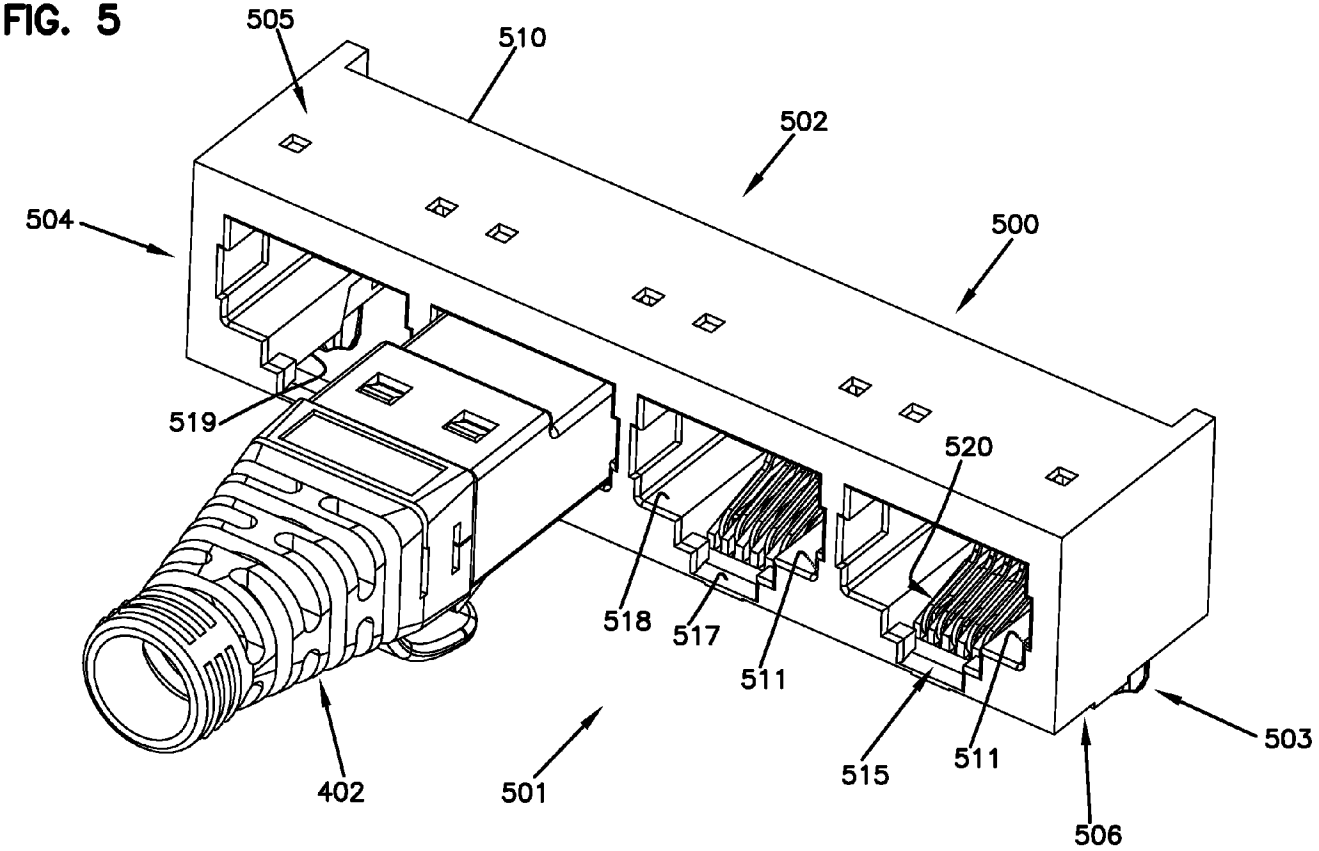
FIG. 5 illustrates one example implementation of a receptacle block defining one or more sockets that each include first contact elements and second contact elements in accordance with aspects of the present disclosure.
Figure 6:
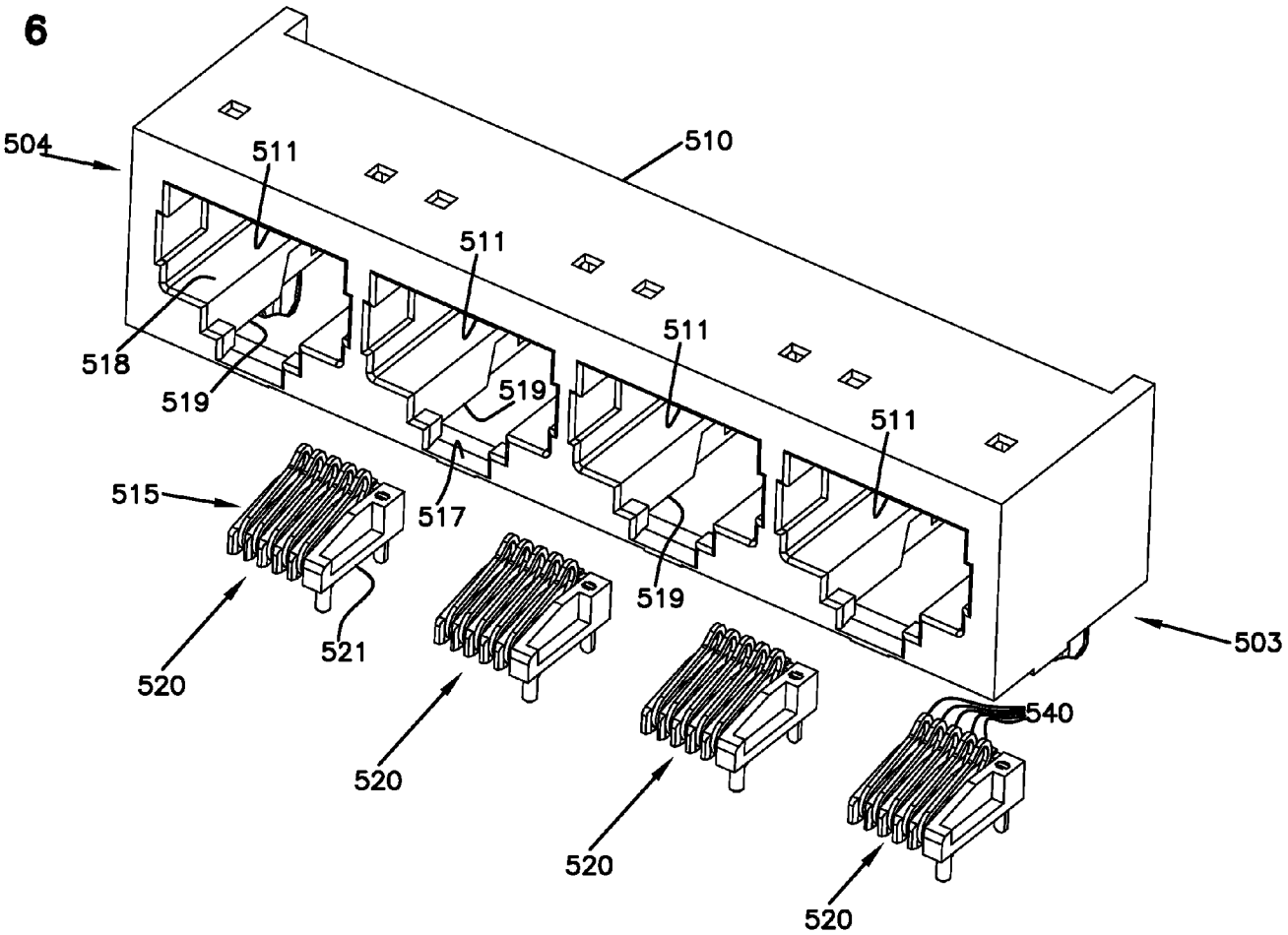
FIG. 6 illustrates the receptacle block of FIG. 5 with the insert arrangements that hold the second contact elements exploded outwardly from the receptacle block.

FIGS. 5 and 6 illustrate one example implementation of a connector assembly 500 that is configured to receive one or more connector plugs 402. In the example shown, the connector assembly 500 includes a receptacle block 510 having a front 501, a rear 502, a first end 503, a second end 504, a first side 505, and a second side 506. The front 501 of the block 510 defines one or more sockets 511 that are each configured to receive an electrical connector, such as connector arrangement 400. In some implementations, the receptacle block 510 is configured to mount to a circuit board (e.g., second circuit board 328 in FIG. 2).

One or more first contact members (e.g., first contacts 322 of FIG. 2) are accessible from each socket 511 and are configured to engage and electrically couple to the main signal contacts 412 of the connector arrangement 400. The first contact members terminate or are coupled to contacts that terminate conductors of an electrical cable (e.g., cable 105 of FIG. 2). The first contact members electrically connect to the printed circuit board to which the receptacle block is attached. In other implementations, the first contact members electrically connect to one or more electrical cables (e.g., directly or via another circuit board). In some implementations, the first contact members include spring contacts. For example, the first contact members may include RJ-45 contacts.

In some implementations, each socket 511 of the receptacle block 510 defines a keyway 517 that is sized and shaped to receive a key member 415 of the connector arrangement 400 to facilitate proper orientation of the connector arrangement 400 within the socket 511. In the example shown, the keyways 517 form part of the entrances to the sockets 511 and extend towards the second end 506 of the block 510. Each socket 511 also may include inner guides 518 that direct the plug connector 402 as plug connector 402 enters and exits the socket 511. For example, the guides 518 may include guide surfaces over which the plug connector 402 can slide during insertion and removal.

In accordance with some aspects of the disclosure, one or more second contact members 515 are accessible from at least one of the sockets 511. The second contact members 515 form a media reading interface configured to read physical layer information from the storage member 415 of the connector arrangement 400 plugged into the respective socket 511 as will be described in more detail herein. The second contact members 515 are electrically isolated from the first contact members. In certain implementations, the second contact members 515 are located at an opposite end of the socket 511 from the first contact members. In one example implementation, the first contact members extend into the socket 511 from the first end 505 of the receptacle block 510 and the second contact members 515 extend into the socket 511 from the second end 506 of the receptacle block 510. In some implementations, each socket 511 provides access to a respective set of second contacts 515. In other implementations, only some of the sockets 511 provide access to a respective set of second contacts 515. For example, alternate sockets 511 may provide access to second contacts 515.

In accordance with some aspects of the disclosure, the second contacts 515 are mounted to one or more support bodies 521 to form one or more media reading interfaces 520. Each media reading interface 520 is coupled to the same circuit board to which the receptacle block 510 is coupled. In some implementations, the media reading interfaces 520 are coupled to the receptacle block 510. In other implementations, the support bodies 521 of the media reading interfaces 520 are monolithically formed with the receptacle block 510. In still other implementations, however, the media reading interfaces 520 fit within one or more openings 519 defined in the receptacle block 510 (see FIG. 6).

In some implementations, a media reading interface 520 is associated with each socket 511. In other implementations, only some of the sockets 511 (e.g., alternate sockets) are associated with media reading interfaces 520. In some implementations, the receptacle block 510 defines a separate opening 519 for each socket 511 that receives second contacts 515. In other implementations, the receptacle block 510 defines an opening 519 that extends across two or more sockets 511. In certain implementations, the receptacle block 510 defines an opening 519 that extends across all of the sockets 511. In certain implementations, the support bodies 521 of the media reading interfaces 520 fit within the opening(s) 519 without attaching to the receptacle block 510. Rather, the media reading interface 520 may be attached (e.g., soldered) to a printed circuit board and the receptacle block 510 may be placed over the media reading interface 520 and attached to the printed circuit board.

FIGS. 7-13 illustrate one example media reading interface 520 including multiple contact elements 540 mounted to a support body 521. At least some of the contact elements 540 form the second contacts 515 that are configured to read physical layer information from a plug connector 402 as will be discussed in more detail herein. A first of the contact elements 540 is configured to detect the presence of a plug connector 402 within the respective socket 511. In certain implementations, the first contact element 540 is not used to read the physical layer information from the plug connector 402. In certain implementations, the first contact element 540 is substantially identical to the other contact elements 540. For example, the first contact element 540 and the other contact elements 540 have identical resilient sections.

Figure 7:
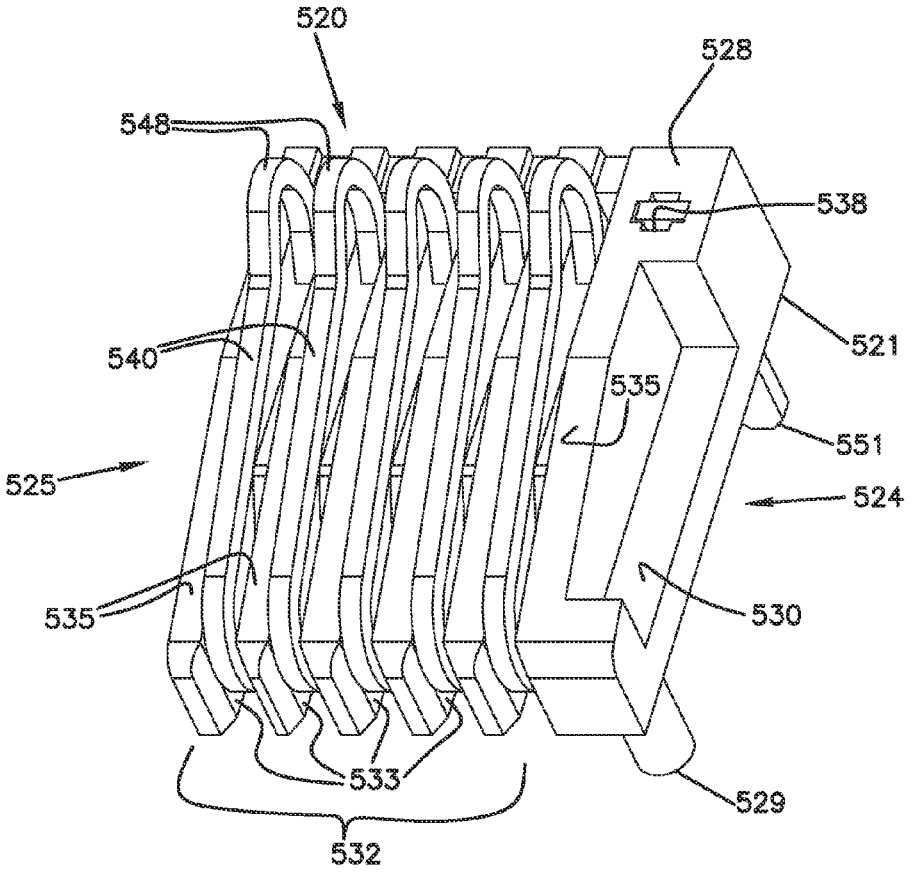
FIG. 7 is a top perspective view of an example insert arrangement including contact elements and a sensing contact mounted to a support body.
Figure 8:
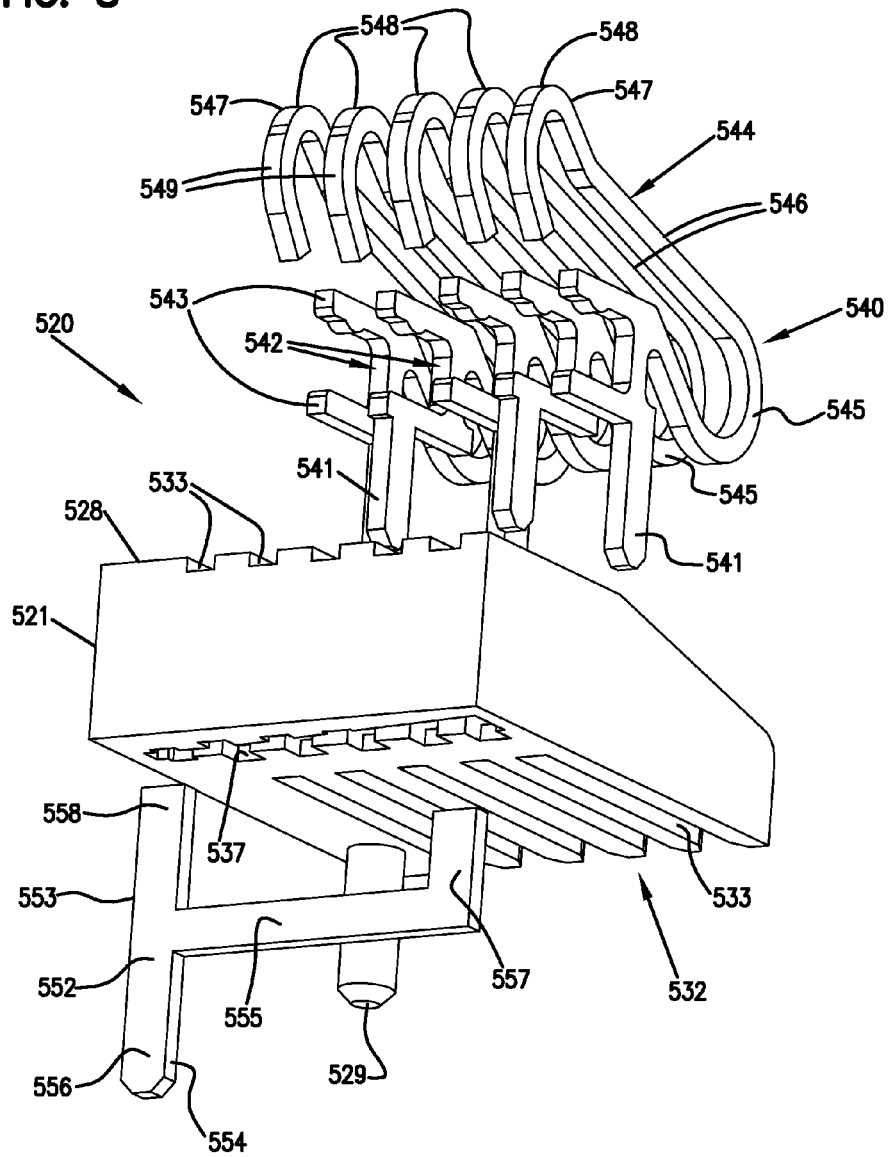
FIG. 8 is a bottom perspective view of the example insert arrangement of FIG. 7 shown with the contact elements and sensing contact exploded out from the support body.
Figure 11:
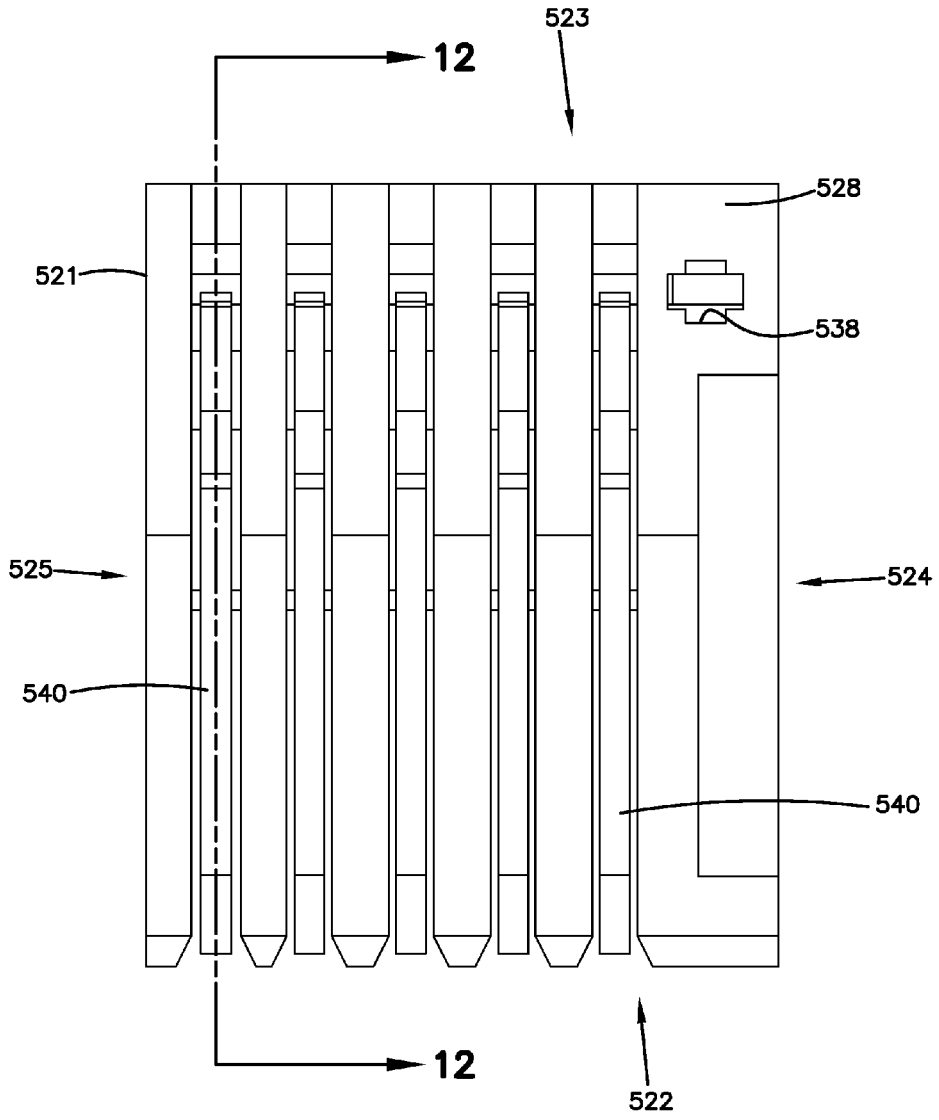
FIG. 11 is a top plan view of the insert arrangement of FIG. 7.
Figure 13:
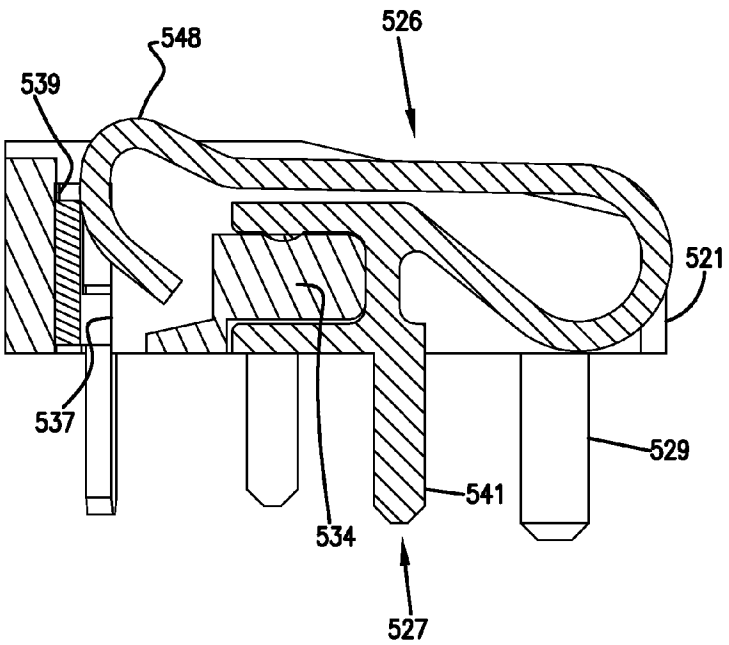
FIG. 13 is a cross-sectional view of the insert arrangement of FIG. 7 taken along the 12-12 line in FIG. 11 with the contact element shown in the depressed position and the sensing contact shown in the flexed position.
Figure 12:
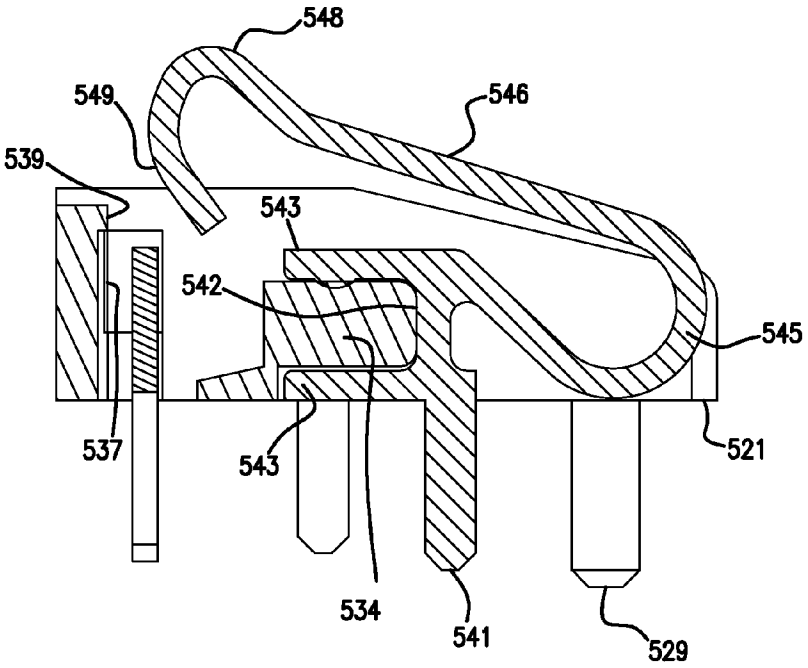
FIG. 12 is a cross-sectional view of the insert arrangement of FIG. 7 taken along the 12-12 line in FIG. 11 with the contact element shown in the raised position and the sensing contact shown in the unflexed position.

As shown in FIGS. 11-13, the support body 521 of the media reading interface 520 has a front 522, a rear 523, a first side 524, a second side 525, a first end 526, and a second end 527. As shown in FIG. 5, the front 522 of the support body 521 faces towards the socket entrance and the rear 523 of the support body 521 faces towards the rear 502 of the receptacle block 510 when the media reading interface 520 is positioned within the opening 519 of the receptacle block 510. As shown in FIGS. 7 and 8, the support body 521 includes a mounting section 528 and a contact section 532. In certain implementations, the contact section 532 is wider than the mounting section 528. In the example shown, the mounting section 528 defines the first side 524 of the support body 521 and the contact section 532 defines the second side 525 of the support body 521.

The mounting section 528 is configured to position the media reading interface 520 relative to the printed circuit board or other structure to properly align the contacts elements 540 with contact pads on the circuit board. A mounting post 529 extends outwardly from the second end 527 of the mounting section 528. The mounting post 529 is shaped and sized to facilitate mounting the support body 521 to a printed circuit board or other such structure. For example, the mounting post 529 may fit into an opening in the board to align the media reading interface 520 relative to the board. In certain implementations, the mounting section 528 also defines a recessed area 530.

The contact section 532 defines one or more contact slots 533 at which the contact elements 540 may be mounted. The contact slots 533 extend along a front-rear axis of the support body 521. In the example shown, each contact slot 533 is sized to receive one of the contact elements 540. In other implementations, however, the slots 533 may receive additional contact elements 540. In some implementations, the support body 521 defines multiple contact slots 533 that are each separated by ribs 535. In certain implementations, portions of the ribs 535 define ramped surfaces that taper downwardly towards the front 522 of the support body 521. The slots 533 extend through at least the first end 526 of the support body 521 to a support region 534 at which the contact elements 540 may be secured to the support body 521. For example, the support region 534 may include a bar, block, or other structure to which the contact elements 540 may snap or otherwise couple (e.g., see FIGS. 12 and 13).

The support body 521 also defines a deflection cavity 537 in which a sensing contact 550 may be disposed. In some implementations, the deflection cavity 537 extends laterally across the support body 521 along a first side-second side axis of the support body 521. In certain implementations, the deflection cavity 537 extends across a majority of the width of the support body 521. In some implementations, the deflection cavity 537 may form a continuous space with one or more of the contact slots 533. A contact aperture 539 extends between the deflection cavity 537 and an exterior of the support body 521. A mounting aperture 538 may extend from the deflection cavity 537 towards the first end 526 of the support body. In the example shown, the mounting aperture 538 extends through the exterior surface of the first end 526 of the support body 521.

Figure 9:
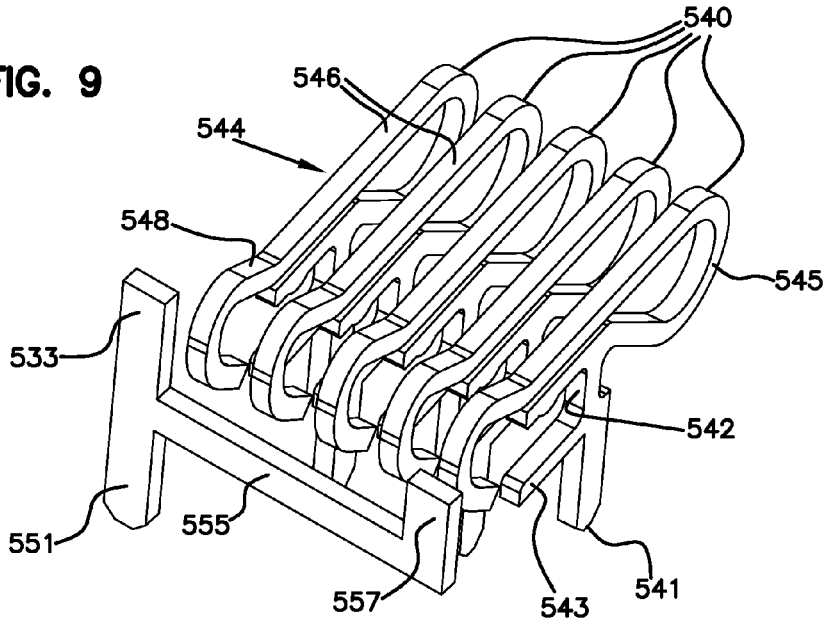
FIG. 9 is a perspective view of the contact elements and sensing contact of the insert arrangement of FIG. 7 shown without the support body for ease in viewing.

Referring to FIGS. 7-9, each contact element 540 includes a connection section 542 and a resilient section 544. The connection section 542 is shaped and configured to secure the contact element 540 to the support region 534 of the support body 521. In some implementations, the connection section 542 includes two spaced fingers 543 that extend outwardly from a base in a C-shape or a U-shape to wrap around the support region 534 of the support body 521. In the example shown, each of the fingers 543 includes an inwardly extending detent, lug, or contoured region that facilitates holding the contact element 540 to the support region 534.

In some implementations, a pin 541 extends from the connection section 542 to facilitate connecting the contact element 540 to the printed circuit board or other such structure.

The pin 541 extends generally parallel to the mounting post 529 of the support body 521. In some implementations, the pin 541 of a first type of contact element 540 extends from a free end of one of the fingers 543 and the pin 541 of a second type of contact element 540 extends from a location closer to the base of the connection section 542. In the example shown, the contact elements 540 are arranged in a row so that the first and second types of contact elements alternate (e.g., see FIG. 8). Accordingly, the pins 541 of adjacent contact elements 540 are offset from each other, thereby facilitating soldering of the pins 541 to the circuit board.

The resilient section 544 of each contact element 540 extends from the connection section 542 to a free distal end. In the example shown, the resilient section 544 includes a beam 546 extending outwardly from a first curved section 545 that is coupled to the connection section 542. The first curved section 545 enables deflection of the distal end of the resilient section 544 between a raised position (FIG. 12) and a depressed position (FIG. 13). In some implementations, a first contact surface 548 may be provided towards the distal end of the resilient section 544. In certain implementations, a second contact surface 549 also may be provided towards the distal end of the resilient section 544.

In certain implementations, a second curved section 547 loops back from one end of the beam 546 towards the connection section 542 of the contact element 540. In the example shown, the second curved section 547 extends upwardly from the beam 546 before looping back. In the example shown, the first contact surface 548 is provided on the portion of the second curved section 547 that extends upwardly from the beam 546. The second contact surface 549 also is provided on the second curved section 547. The second contact surface 549 is offset along the length of the resilient portion from the first contact surface 548.

In some implementations, the contact element 540 has a circumferential edge extending between planar major sides. In certain implementations, the edge of each contact element 540 defines the first and second contact surfaces 548, 549 (see FIGS. 7 and 8). In some implementations, the edge has a substantially continuous thickness. In certain implementations, the thickness is less than about 0.02 inches. In some implementation, the thickness is less than about 0.012 inches. In one implementation, the thickness is about 0.008 inches. In other implementations, the thickness may vary across the body of the contact element 540. For example, each contact element 540 may be formed by etching, stamping, laser-trimming, or cutting a sheet of conductive material. In other implementations, the contact elements 540 may be formed of bent metal wire.

Referring to FIGS. 8 and 9, the sensing contact 550 also has a circumferential edge extending between planar major sides 552, 554. In some implementations, the edge has a substantially continuous thickness. In certain implementations, the thickness is less than about 0.02 inches. In some implementation, the thickness is less than about 0.012 inches. In one implementation, the thickness is about 0.008 inches. In other implementations, the thickness may vary across the body of the sensing contact 550. For example, the sensing contact 550 may be formed by etching, stamping, laser-trimming, or cutting a sheet of conductive material.

The sensing contact 550 includes a deflecting section that extends between a swiping section and a mounting section. The mounting section secures the sensing contact 550 to the support housing 521 and the swiping section aligns with one of the contact elements 540 for selective engagement therewith. The deflecting section is configured to bend or flex so that the swiping section moves relative to the mounting section. In certain implementations, the deflecting section flexes along the planar sides 552, 554 of the sensing contact 550.

In the example shown, the sensing contact 550 includes a deflecting beam 555 extending between a first flange 553 and a second flange 557. The deflecting beam 555 is configured to flex so that the second flange 557 may move relative to the first flange 553 between an unflexed position (FIG. 12) and a flexed position (FIG. 13). When the sensing contact 550 is in the unflexed position, the first planar surface 552 of the second flange 557 is parallel to the first planar surface 552 of the first flange 553. In the example shown, the first and second flanges 553, 557 are coplanar when unflexed. When the sensing contact 550 is in the flexed position, however, the first planar surface 552 of the second flange 557 is angled relative to the first planar surface 552 of the first flange 553.

In some implementations, the first flange 553 defines a pin 556 that is sized and shaped to facilitate connecting the sensing contact 550 to the printed circuit board or other such structure. The pin 556 extends generally parallel to the pins 541 of the contact elements 540 and the mounting post 529 of the support body 521. In some implementations, the first flange 553 defines a securement section 558 that is configured to extend into the support body 521 to aid in holding the sensing contact 550 within the deflection cavity 537 of the support body 521. In certain implementations, the securement section 558 extends into the mounting aperture 538 defined in the mounting section 528 of the support body 521.

The second flange 557 extends upwardly from the deflecting beam 555. In the example shown, the second flange 557 does not extend upwardly as high as the first flange 553. In other implementations, however, the second flange 557 may extend upwardly flush with the first flange 553 or higher than the first flange 553. The second flange 557 defines a contact surface 559. In some implementations, the contact surface 559 is defined along the second major surface 554. In other implementations, the contact surface 559 is defined at least partially along the circumferential edge of the sensing contact 550.

Figure 10:
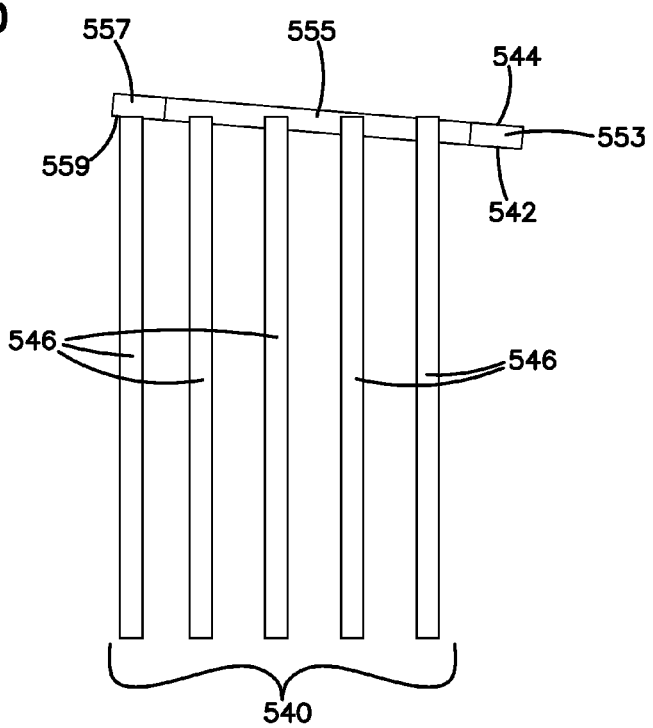
FIG. 10 is a top plan view of the contact elements and sensing contact of FIG. 9.

FIGS. 9 and 10 illustrate the relationship between the contact elements 540 and the sensing contact 550. For ease in viewing, these figures show the contacts 540, 550 without the support body 521. In accordance with some aspects of the disclosure, the contact elements 540 and sensing contact 550 are positioned and oriented so that movement of the contact elements 540 from the raised position to the depressed position (e.g., resulting from insertion of a plug connector 402 into a socket 511) will bring a first of the contact elements 540 into physical contact with the sensing contact 550. The other contact elements 540 do not touch the sensing contact 550.

In some implementations, the sensing contact 550 is coupled to ground. Accordingly, contact between the first contact element 540 and the sensing contact 550 completes (or shorts) an electrical circuit, which may be detected by a processor (e.g., processor 206 of FIG. 1) coupled to the circuit board. Therefore, completion of the electrical circuit may indicate that an object (e.g., a plug connector 402) has been inserted into the socket 511. After detecting the insertion, the processor may attempt to read information from the object via the other contact elements 540. Maintaining isolation of the other contact elements 540 from the sensing contact 550 inhibits interference between the plug connector memory 420 and the processor.

As shown in FIG. 8, the sensing contact 550 is positioned at the distal ends of the resilient sections 544 of the contact elements 540 when the sensing contact 550 is disposed in the deflection cavity 537 and the contact elements 540 are disposed in the contact slots 533. As shown in FIG. 9, the deflecting beam 555 of the sensing contact 550 extends across at least a majority of the contact elements 540. The distal end of the resilient section 544 of the first contact element 540 is aligned with the second flange 557. The distal ends of the resilient sections 544 of the other contact elements 540 are aligned over the deflection beam 555 between the first and second flanges 553, 557. Accordingly, when the contact elements 540 are in the depressed positions, the second contact surfaces 549 of all but one of the contact elements 540 remain spaced from the sensing contact 550. The second contact surface 549 of the first contact element 540, however, touches (e.g., swipes) against the contact surface 559 of the sensing contact 550.

In accordance with certain aspects of the disclosure, that movement of the first contact element 540 from the raised position to the depressed position will move the sensing contact 550 from the unflexed position to the flexed position. For example, as shown in FIGS. 9, 10, 12, and 13, the second contact surface 549 of the first contact element 540 presses against the contact surface 559 of the sensing contact when the first contact element 540 is depressed. The first contact element 540 pushes against the second flange 557 of the sensing contact 550 so that the second contact 557 moves within the deflection cavity 537 away from the first contact element 540 (e.g., see FIGS. 12 and 13). Movement of the contact surface 559 of the sensing contact 550 allows for prolonged contact between the second contact surface 549 of the first contact element 540 and the contact surface 559 of the sensing contact 550. Accordingly, deflection of the sensing contact 550 results in a more robust detection system by accommodating tolerances in part dimensions and positioning.

The above specification provides a complete description of the present invention. Since many embodiments of the invention can be made without departing from the spirit and scope of the invention, certain aspects of the invention reside in the claims hereinafter appended.

The invention claimed is:

1. A receptacle block comprising:

a block housing having a front, a rear, a first end, a second end, a first side, and a second side, the block housing defining at least one socket configured to receive a plug from the front of the block housing, the block housing defining at least one opening aligned with the at least one socket, the at least one opening extending between the at least one socket and an exterior of the block housing;

a plurality of first contact members extending into each socket from the first end of the block housing, each of the first contact members being electrically conductive; and at least a first media reading interface positioned within the at least one opening of the block housing, the first media reading interface including a plurality of electrically conductive second contact members and an electrically conductive sensing contact;

the second contact members extending into the socket from the second end of the block housing, each of the second contact members being electrically isolated from the first contact members, and each of the second contact members having a resilient section that is configured to move between a raised position and a depressed position; and the sensing contact being physically separate and electrically isolated from the second contact members when the resilient sections of the second contact members are in the raised positions, the sensing contact having a deflecting section that extends between a mounting section and a swiping section, the sensing contact extending laterally across the second contact members so that the swiping section is aligned with a first of the second contact members and the deflecting section extends across a remainder of the second contact members so that movement of the resilient sections of the second contact members to the depressed positions causes the first of the second contact members to engage the swiping section of the sensing contact and the remainder of the second contact members to maintain physical separation and electrical isolation from the sensing contact.

2. The receptacle block of claim 1, further comprising a printed circuit board coupled to at least some of the second contact members.

3. The receptacle block of claim 1, wherein the first contact members include RJ-45 pin members.

4. The receptacle block of claim 1, wherein the first media reading interface is not coupled to the block housing.

5. The receptacle block of claim 1, wherein the plurality of second contact members includes at least four contact members.

6. The receptacle block of claim 5, wherein the plurality of second contact members includes five contact members.

7. The receptacle block of claim 1, wherein the block housing defines a plurality of sockets, each socket receiving a respective plurality of first contact members and a respective media reading interface.

8. The receptacle block of claim 1, wherein the first media reading interface includes a support body to which the second contact members and the sensing contact couple.

9. The receptacle block of claim 1, wherein the swiping section of the sensing contact is configured to move between an unflexed position and a flexed position when the first of the second contact members moves between the raised position and the depressed position.

10. The receptacle block of claim 1, wherein the resilient sections of the second contact members are laterally aligned with each other.

11. A media reading interface comprising:

a support body defining contact slots and a deflection cavity, the deflection cavity extending laterally relative to the contact slots;

an electrically conductive sensing contact disposed in the deflection cavity, the sensing contact having a deflecting section that extends between a mounting section and a swiping section;

a plurality of electrically conductive contact elements disposed in the contact slots and attached to the support body, each of the contact elements including a resilient section that laterally aligns with the resilient section of the other contact elements, the resilient section of each contact element being configured to move between a raised position and a depressed position, each of the contact elements being physically separated and electrically isolated from the sensing contact when in the raised position;

the sensing contact extending generally orthogonal to the contact elements;

a first of the contact elements being aligned with the swiping section of the sensing contact so that movement of the first contact element towards the depressed position brings the first contact element into engagement with the swiping section of the sensing contact; and a remainder of the contact elements being aligned with the deflecting section of the sensing contact so that movement of the remainder of the contact elements towards the depressed positions does not bring the remainder of the contact elements into physical or electrical contact with the sensing contact.

12. The media reading interface of claim 11, wherein the support body defines a mounting section and a contact section, the mounting section configured to receive the mounting section of the sensing contact, the contact section defining the contact slots.

13. The media reading interface of claim 11, wherein the sensing contact includes a pin configured to couple the sensing contact to a printed circuit board.

14. The media reading interface of claim 13, wherein the pin extends downwardly in line with the mounting section of the sensing contact.

15. The media reading interface of claim 14, wherein the sensing contact has a circumferential edge that extends between opposite planar surfaces, the planar surfaces defining a "4" shape.

16. The media reading interface of claim 13, wherein the swiping section of the sensing contact is shorter than the mounting section.

17. The media reading interface of claim 11, wherein the connection section of each contact element includes two fingers extending outwardly from a base.

18. The media reading interface of claim 11, wherein the resilient section of each contact element includes a beam extending between a first curved region and a second curved region.

19. The media reading interface of claim 18, wherein the second curved region of the resilient section of the first contact element defines a contact surface that engages the swiping section of the sensing contact when the first contact element is moved towards the depressed position.

20. A method of assembling a connector assembly including a receptacle block, at least a first media reading interface, and a printed circuit board, the method comprising:

mounting the first media reading interface to the printed circuit board, the first media reading interface including a plurality of contact elements having identical resilient sections;

positioning the receptacle block over the printed circuit board so that an opening defined in the receptacle block is aligned with the first media reading interface; and mounting the receptacle block directly to the printed circuit board so that the contact elements of the first media reading interface extend into a socket of the receptacle block through the opening, the receptacle block not being directly coupled to the first media reading interface.

21. The method of claim 20, further comprising mounting a plurality of additional media reading interfaces to the printed circuit board, each of the additional media reading interfaces including a plurality of contact elements having identical resilient sections;

wherein positioning the receptacle block over the printed circuit board aligns a plurality of additional openings defined in the receptacle block with the additional media reading interfaces; and wherein the contact elements of the additional media reading interfaces extend into respective sockets of the receptacle block through the additional openings when the receptacle block is mounted to the printed circuit board, the receptacle block not being directly coupled to the additional media reading interfaces.

* * * * *